US005775944A

United States Patent [19]

Flask et al.

[11] Patent Number: 5,775,944

[45] Date of Patent: Jul. 7, 1998

[54] SEALED CONNECTOR-TO-BODY INTERFACE

[75] Inventors: William George Flask, Youngstown; John Henry Bakker, Cortland, both of Ohio

[73] Assignee: General Motors Corporation, Detroit, Mich.

[21] Appl. No.: 699,368

[22] Filed: Aug. 19, 1996

[51] Int. Cl.[6] ..... H01R 13/73

[52] U.S. Cl. ..... 439/556

[58] Field of Search ..... 439/556, 559, 439/548

[56] References Cited

U.S. PATENT DOCUMENTS

| | | | |
|---|---|---|---|
| 3,753,212 | 8/1973 | Yamada et al. | 439/556 |
| 4,862,011 | 8/1989 | Wright | 307/10.1 |
| 4,941,258 | 7/1990 | Wright | 29/858 |
| 5,501,609 | 3/1996 | Watanabe | 439/556 |
| 5,586,909 | 12/1996 | Saba | 439/559 |

*Primary Examiner*—Gary F. Paumen
*Attorney, Agent, or Firm*—Anthony Luke Simon

[57] ABSTRACT

A sealed connector-to-body interface comprising: a substantially planar body surface; an electrical connector including a housing having a shoulder proximate to one end thereof, wherein the electrical connector is affixed to the planar body surface and the shoulder is aligned substantially parallel to the planar body surface and spaced apart therefrom, wherein the shoulder includes a first shoulder surface facing the planar body surface; and a grommet mounted to the connector extending away from the planar body surface, wherein the grommet includes an annular radially extending wall abutting the first shoulder surface and an annular lip seal compressed between the shoulder and a first side of the planar body surface facing the shoulder.

7 Claims, 4 Drawing Sheets

SEALED CONNECTOR-TO-BODY INTERFACE

BACKGROUND OF THE INVENTION

In many automotive vehicles, electrical power is provided from a power source in the vehicle body to switches, lights and/or actuators contained in vehicle doors. Because the typical vehicle door is mounted to the body vis-a-vis one or more hinges, the connection of power between the body and the door must take into account the hinge structure. One known manner for coupling the power from the body to the door is through an electrical harness that is protected from the weather by a sealed grommet with one end affixed to the vehicle door and the other end affixed to the vehicle body. The sealed grommet contains a sealed passage through which the electrical harness wires pass without being exposed to water, salt or other road or weather environmental factors.

In another known grommet seal system, a grommet is mounted to a shoulder of an intermediate piece, typically of molded plastic, which is snapped into the opening in the vehicle door frame leading to the space between the vehicle body and the vehicle door. When the intermediate piece is snapped in place, the grommet maintains a flush seal against the metal of the frame. An electrical connector is then snapped in place within the intermediate piece and a harness is provided running through the grommet.

SUMMARY OF THE PRESENT INVENTION

It is an object of this invention to provide a sealed connector-to-body interface.

Advantageously, this invention provides a sealed connector-to-body interface for allowing passage of electrical conductors through a body, such as a door frame pillar on a vehicle to an environment between the door frame pillar and the vehicle door from which the electrical wires must be sealed.

Advantageously, this invention provides a sealed connector-to-body interface that affects a seal by a flush engagement of a grommet with a surface of the body, eliminating the requirement for the grommet to pass through an opening of the body.

Advantageously, this invention provides a sealed connector-to-body interface that allows an electrical connector to be mounted in an opening between an interior of the body and an exterior of the body, for example, in a door frame pillar of a motor vehicle.

Advantageously, this invention provides a sealed connector-to-body interface that allows the grommet that protects the wires passing from the door frame pillar to the door to be attached to the connector that is mounted in the door frame pillar.

Advantageously, with the connector mounted in the opening and the grommet attached to the connector, the connector holds the grommet in place so that the grommet provides a flush seal against the face of the door pillar.

Advantageously, in a preferred example, the flush seal on the grommet has a design that allows ease of engagement of the seal while still providing adequate seal protection. More particularly, the seal is provided in a double lip configuration formed by two concentric lip seals, one radially interior of the other, wherein the radially outer seal extends beyond an outer periphery of a shoulder on the connector and provides a barrier to most of the exterior elements. The radially inner seal is completely within the outer periphery of the shoulder and thus is under greater compression, providing a complete flush seal.

Advantageously then, according to a preferred example, this invention provides a sealed connector-to-body interface comprising: a substantially planar body surface; an electrical connector including a housing having a shoulder proximate to one end thereof wherein the electrical connector is affixed to the planar body surface and the shoulder is aligned substantially parallel to the planar body surface and spaced apart therefrom, wherein the shoulder includes a first shoulder surface facing the planar body surface; and a grommet mounted to the connector and extending away from the planar body surface wherein the grommet includes an annular radially extending wall abutting the first shoulder surface and an annular lip seal compressed between the shoulder and a first side of the planar body surface facing the shoulder.

According to another preferred example, the connector housing is provided with a plurality of cantilever arms, each with a ramp and a locking seat wherein the locking seats abut a second side of the planar body surface opposite the first side and facing away from the shoulder, wherein the cantilever arms maintain the housing affixed to the planar body surface.

BRIEF DESCRIPTION OF THE DRAWINGS

The present invention will now be described by way of example with reference to the following figures in which.

DETAILED DESCRIPTION OF THE INVENTION

Figure 1:
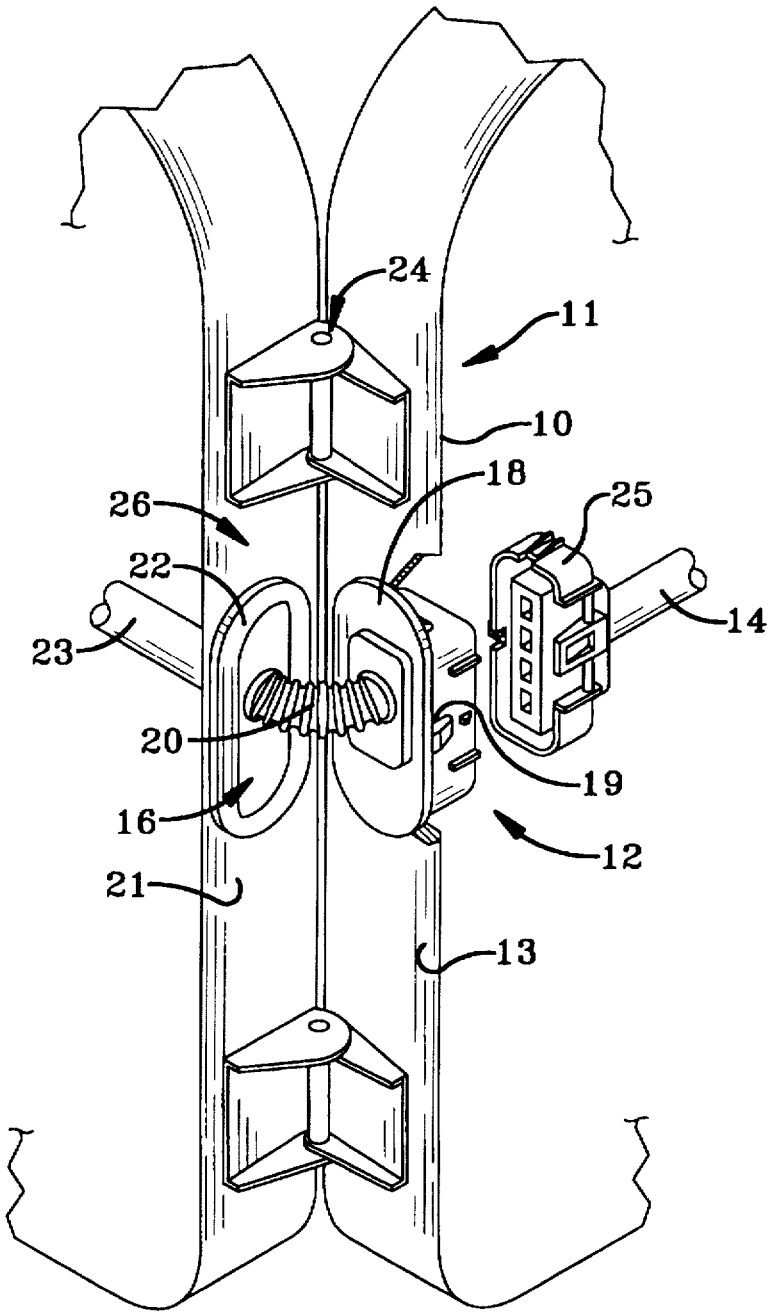
FIG. 1 illustrates an example sealed connector-to-body interface according to this invention.

Referring now to FIG. 1, an example door frame pillar 11 of a vehicle body has mounted thereto one or more hinges 24 by which the vehicle door 26 is mounted to the body. Harness 14 carries electrical power and other signals that are desirable to interface with the door 26. The harness 14 terminates at connector assembly 12, which comprises male and female connectors 19 and 25 mated together to couple the electrical conductors in harnesses 14 and 23 in a suitable manner. Harness 23 travels through the tubular portion 20 of grommet 16 and into the interior of the door 26 to various vehicle door systems such as courtesy lights, power window switches and actuators and power door lock switches and actuators, etc.

The surface 21 of the door 26 has an oval opening, not shown, of a type known to those skilled in the art in which end 22 of the grommet 16 is attached in a known manner by passing through the opening and seating therein to provide a weather-sealed interface with the surface 21 of the door 26. The second end 18 of the grommet 16 interfaces with the pillar 11 and the connector 19 in a manner that does not require the end 18 of grommet 16 to pass through the opening in the pillar surface 10 but instead provides a flush lip seal against the outer surface 13 of the pillar 10.

Further, the sealed interface at end 18 allows the connector 19 to be snapped in place in the metal 10 and extend therethrough and allows the grommet end 18 to be fastened to the connector 19 to maintain the end 18 of the grommet 16 in place. This structure provides the advantages of a sealed interface allowing passage of the electrical interconnect between the body 11 and the door 26 with attachment of the connector 19 to the opening in the body pillar 10. The flush seal on end 18 of grommet 16 protects the electrical interconnect from exposure to water and other weather and road-related elements.

Figure 2:
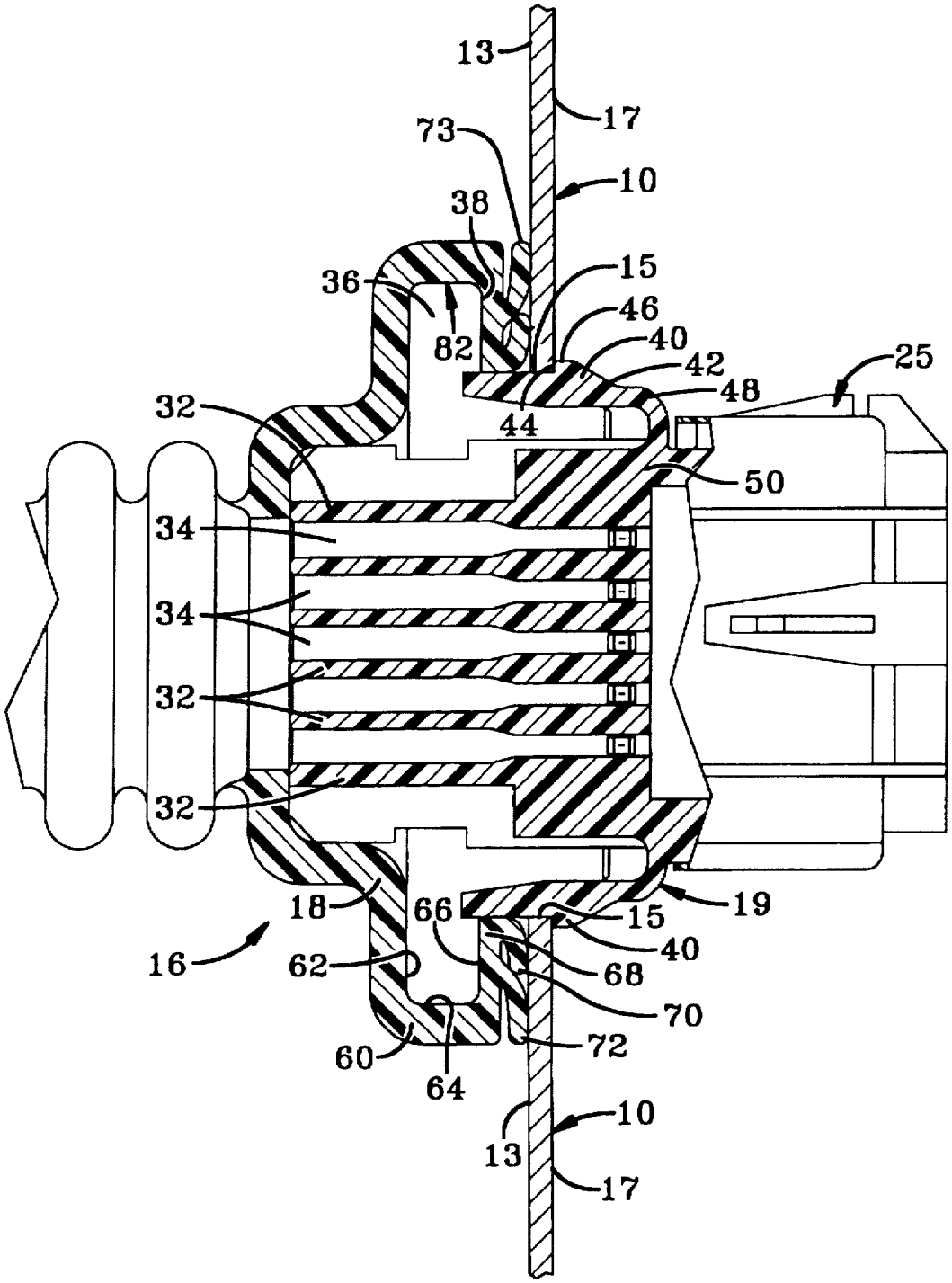
FIG. 2 illustrates an example section view of a sealed connector-to-body interface according to this invention.

Referring now to FIG. 2, the pillar surface 10 typically comprises sheet metal that is substantially planar in an area where the electrical interconnect is to pass through the metal 10. An opening 15 is provided in the metal 10, which opening 15 may, for example, have a generally oval shape or other shape as necessary to match the shape of the connector 19 that passes through the opening 15.

The connector 19 is an integrally molded plastic body including many structural aspects that are well known to those skilled in the art. For example, partitions 32 divide cylindrical openings 34 within which are typically mounted terminals of a known type (not shown) for terminating electrical harness wires of a known type of harness 23 (FIG. 1) and coupling the signals from harness 23 through a mating connector 25 (FIG. 1) of a known type to harness 14 (FIG. 1).

In the example shown, a plurality (i.e., four) of arcuately spaced cantilever arms 40 extend from the body portion 50 of the connector 19. Each cantilever arm 40 has a bent flex arm 48 leading to the ramp 42 and lock portion 46. The lock portion 46 has a seat 44 for engaging the surface 17 of the pillar metal 10. On the opposite side of the metal 10, an annular shoulder 36 extends from all or a substantial portion of the periphery around the connector 19. The shoulder 36 is aligned substantially parallel to the metal 10 and spaced apart therefrom facing surface 13. The end 18 of the grommet 16 has an inner peripheral seat 60 defined by radially directed surfaces 62 and 66 spaced apart by axially directed surface 64. The seat 60 and its surfaces 62, 64 and 66 form an annular track 82 that engages the shoulder 36 on three sides thereof. The grommet comprises a rubber or elastomeric material of a known type and the end 18 can be stretched over the shoulder 36 and returns to its natural form once correctly positioned on the shoulder 36, at which point, the grommet 16 is firmly attached to the shoulder 36.

The radial wall 68, which forms the surface 66, is located between the shoulder 36 and the metal 10. It has extending therefrom, in the example shown, two annular lips 70 and 72, concentrically aligned, with lip 70 radially interior of lip 72. The lips 70 and 72 follow a path shaped to match the surface 13 around the opening 15. For example, where the opening is oval, the lips 70 and 72 are concentric ovals.

With connector 19 snapped in place within the opening 15 and maintained locked there by the cantilever arms 40, the lips 70 and 72 and wall 68 are compressed between the shoulder 36 and the surface 13 of the metal 10. Both lips 72 and 70 are deflected radially outward and engage the surface 13 of the metal 10 in a dual lip seal configuration that prevents entry of water, dust, road salt and other weather and road elements from the exterior of the grommet 16 to the interior thereof, thus providing environmental protection for the electrical interconnect passing through the grommet 16 and the opening 15 through the metal 10.

In the preferred example, at least the lip 70 is in compression so that elastomeric force maintains the lip 70 pressed against the surface 13 for the entire perimeter around opening 15, ensuring the sealing function of the connection system.

Figure 3:
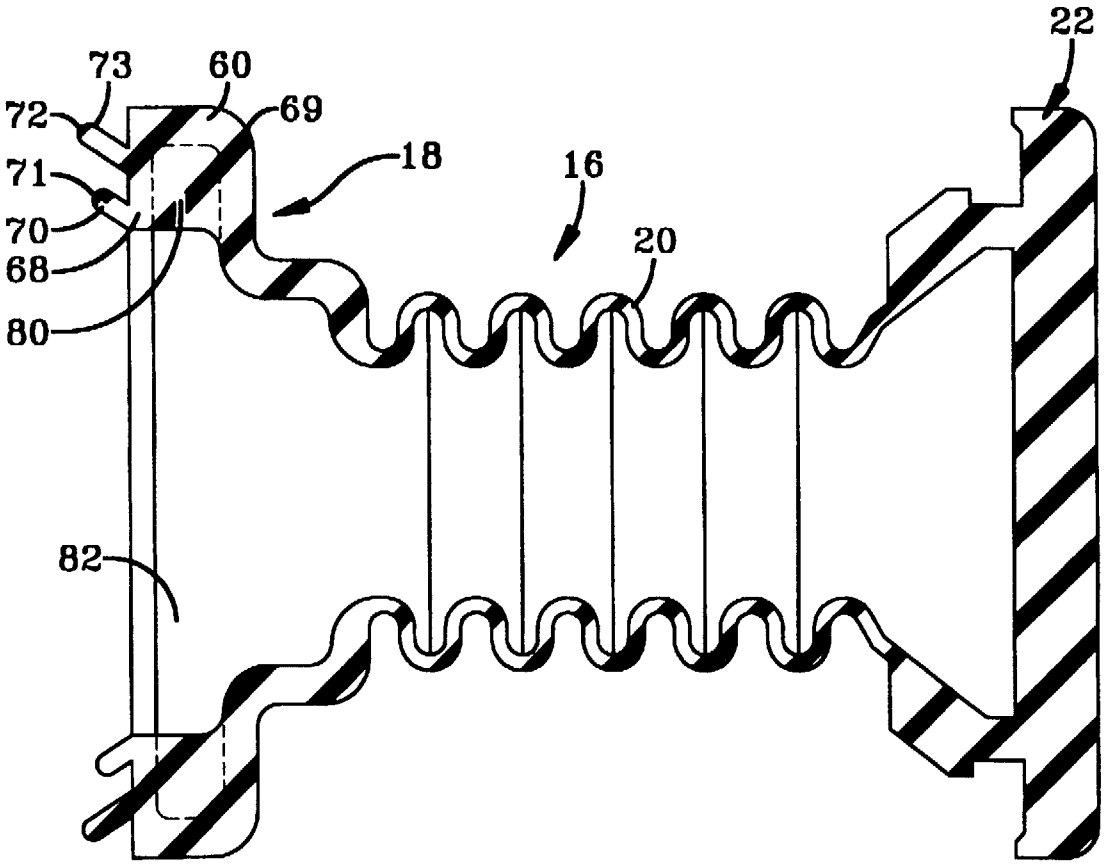
FIG. 3 illustrates an example grommet for use with a sealed connector-to-body interface according to this invention.

FIG. 3 illustrates the grommet 16, including the lips 70 and 72 in their uncompressed state. In the preferred example, the outer lip 72 is longer than the inner lip 70. Both lips 70 and 72 project at an angle to surface 68 so that they both extend axially away from the remainder of the grommet 16 and so that the free ends 71, 73 of the lips 70 and 72 extend radially outwardly.

The lip design shown provides an advantageous function as shown in FIG. 2. When the connector 19, grommet 16 and body metal 10 are assembled together, the end of the radially exterior lip 72 that is attached to wall 68 is within the exterior periphery 75 of the shoulder 36 and the free end 73 of the radially exterior lip 72 is pressed against surface 13 and extends beyond the exterior periphery 75 of the shoulder 36. The radially interior lip 70, however, is completely within the exterior periphery 75 of shoulder 36, causing it to be compressed between the shoulder 36 and the surface 13, giving seal 70 a tighter sealing force against surface 13. The result is that the outer seal 72 is more free than the inner seal 70, but still prevents entry of most of the exterior weather and road elements. The inner seal 70, in compression, provides a higher quality seal, ensuring that any elements that pass outer seal 72 do not intrude to the interior of the grommet 16.

The practical advantage of the double seal configuration is that it eases assembly of the sealed interface. For example, other seal designs require high force to assemble the interface so that the seal is engaged to the metal, making the assembly task more difficult for the human installer. The double lip design shown provides for a high quality seal while reducing the effort necessary to assemble the interface.

At the end 22 of the grommet 16, a conventional structure for interfacing the grommet to sheet metal, for example, of a vehicle door or body pillar, is shown.

Figure 4:
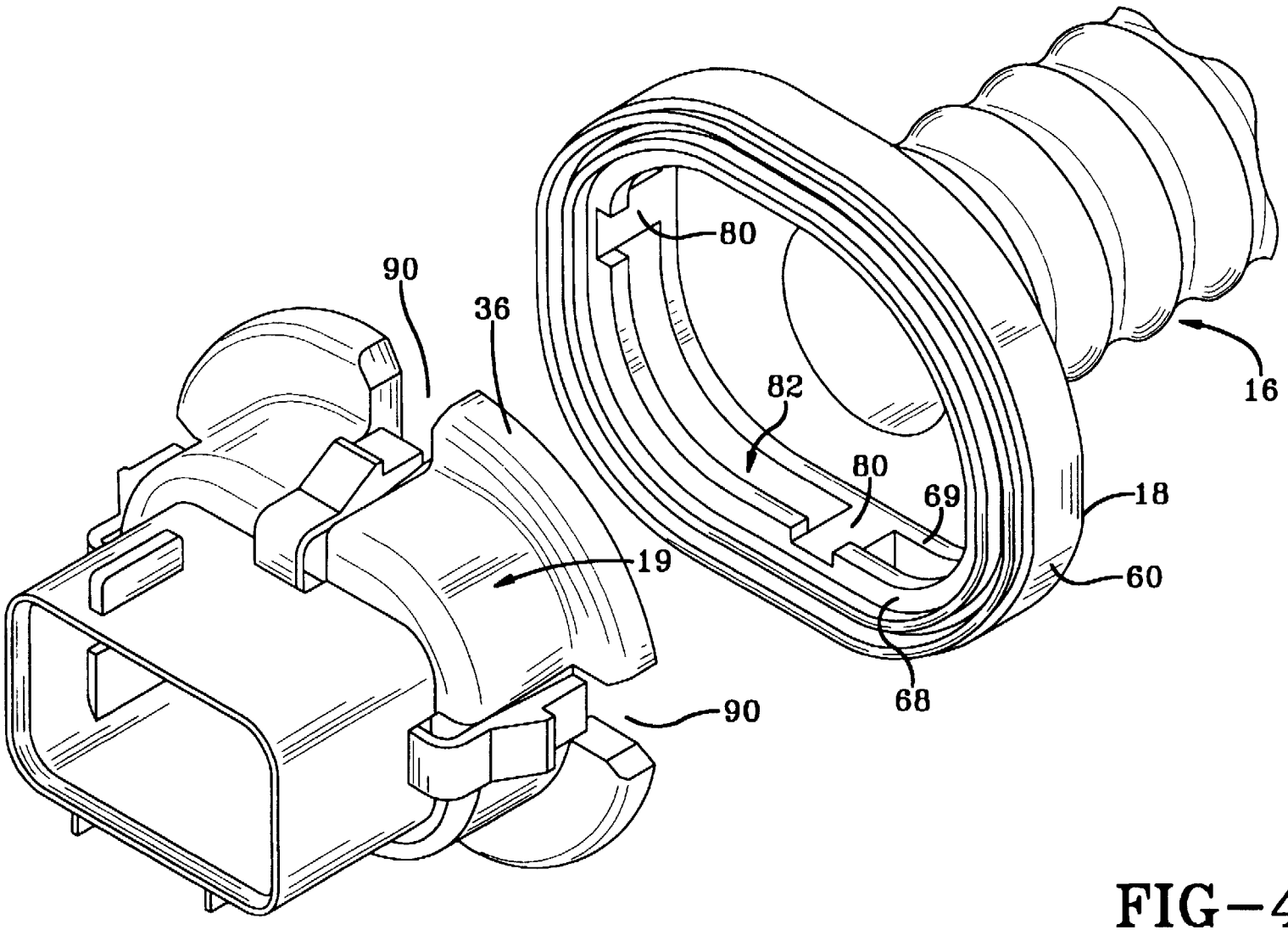
FIG. 4 illustrates a view of an example connector for use with this invention.

Referring now also to FIG. 4, in the preferred example, the annular track 82 of the seat 60 of the end 18 of grommet 16 has a plurality of spaced apart ribs 80 connecting the radial wall 68 with the opposite radial wall 69. To accommodate the ribs 80, gaps 90 are provided in the shoulder 36 of the connector 19. The ribs 80 provide a structural connection between the walls 68 and 69 preventing the grommet seat 60 from easily deforming and sliding off the shoulder 36 in response to tensile force between the grommet 16 being pulled in one direction and the connector 19 being pulled in the opposite direction.

To achieve assembly of the system shown, the harness 23 (FIG. 1) for the connector 19 is passed through the tubular portion 20 of the grommet 16 and the connector 19 is attached to the grommet 16 by placing the annular seat 60 over the shoulder 36. The connector 19 is then slid through the opening 15 of the metal 10 from the direction of side 13. During the process of sliding the connector 19 through the opening 15, the periphery of the opening 15 acts on the ramps 42 of the cantilever arms 40 deflecting the cantilever arms 40 inward until the locking surfaces 44 snap in place against the surface 17 of the metal 10, after which occurrence the connector 19 is locked in place. During the locking process, the lips 70 and 72 are compressed by the shoulder 36 and the surface 13 of the metal 10 to achieve the state shown in FIG. 2.

We claim:

1. A sealed connector-to-body interface comprising:

a substantially planar body surface;

an electrical connector including a housing having a shoulder proximate to one end thereof, wherein the electrical connector is affixed to the planar body surface and the shoulder is aligned substantially parallel to the planar body surface and spaced apart therefrom, wherein the shoulder includes a first shoulder surface facing the planar body surface; and a grommet mounted to the connector extending away from the planar body surface, wherein the grommet includes (i) an annular radially extending wall abutting the first shoulder surface, (ii) a first annular lip seal mounted to the annular radially extending wall and compressed between the shoulder and a first side of the planar body surface facing the shoulder and (iii) a second annular lip seal mounted to the annular radially extending wall concentrically with the first annular lip seal and radially exterior thereof, wherein the first annular lip seal is radially interior of an exterior periphery of the shoulder and wherein the second annular lip seal extends to a radial exterior of the exterior periphery of the shoulder.

2. A sealed connector-to-body interface according to claim 1, wherein the planar body surface comprises part of a pillar for a vehicle door frame and wherein the grommet includes a sealed flexible tubular passage that extends between the pillar and a vehicle door.

3. A sealed connector-to-body interface according to claim 1, wherein the connector housing includes a plurality of cantilever arms, each with a ramp and a locking seat, wherein the locking seats abut a second side of the planar body surface opposite the first side and facing away from the shoulder, wherein the cantilever arms maintain the housing affixed to the planar body surface.

4. A sealed connector-to-body interface comprising:

a substantially planar body surface having an opening therein;

an electrical connector including a housing having a shoulder proximate to one end thereof, wherein the electrical connector is affixed to the planar body surface and extends through the opening, wherein the shoulder is aligned substantially parallel to the planar body surface and spaced apart therefrom, wherein the shoulder includes a first shoulder surface facing the planar body surface; and a grommet mounted to the connector extending away from the planar body surface, wherein the grommet includes (i) an annular radially extending wall abutting the first shoulder surface, (ii) a first annular lip seal mounted to the annular radially extending wall and compressed between the shoulder and a side of the planar body surface facing the shoulder and (iii) a second annular lip seal, mounted to the annular radially extending wall concentrically with the first annular lip seal and radially exterior thereof, wherein the first annular lip seal is radially interior of an exterior periphery of the shoulder and wherein the second annular lip seal has an attached end within the exterior periphery of the shoulder and a free end exterior of the exterior periphery of the shoulder.

5. A sealed connector-to-body interface according to claim 4, wherein the second annular lip seal is longer than the first annular lip seal.

6. A sealed connector-to-body interface according to claim 4, wherein the first annular lip seal is in greater compression than the second annular lip seal.

7. A sealed connector-to-body interface comprising:

a vehicle body door frame having a substantially planar surface dividing an interior of the vehicle body door frame from an exterior thereof;

an opening in the vehicle body door frame;

a vehicle door having an interior thereof;

at least one hinge for maintaining the vehicle door mounted to the vehicle body door frame;

a connector housing mounted in the opening and extending from the interior of the vehicle body door frame to the exterior thereof, wherein the connector housing includes a shoulder located exterior of the vehicle body door frame and spaced apart therefrom;

a grommet connected to the shoulder of the connector and extending between the vehicle body door frame and the vehicle door;

a first annular lip seal on the grommet located between the shoulder and the vehicle body door frame, wherein the first annular lip seal engages an exterior surface of the vehicle body door frame around a periphery of the opening; and a second annular lip seal, mounted concentrically with the first annular lip seal and radially exterior thereof, wherein the first annular lip seal is radially interior of an exterior periphery of the shoulder and wherein the second annular lip seal has an attached end within the exterior periphery of the shoulder and a free end exterior of the exterior periphery of the shoulder, wherein a weather-sealed passage is provided from the interior of the vehicle body door frame to the interior of the door.

* * * * *